United States Patent [19]

Nishimura et al.

[11] Patent Number: 4,859,289

[45] Date of Patent: Aug. 22, 1989

[54] PROCESS FOR PRODUCING A METAL WIRE USEFUL AS RUBBER PRODUCT REINFORCEMENT

[75] Inventors: Yoshifumi Nishimura; Yoshio Yoshimura, both of Hyogo, Japan

[73] Assignee: Sumitomo Electric Industries, Ltd., Osaka, Japan

[21] Appl. No.: 53,669

[22] Filed: May 26, 1987

[30] Foreign Application Priority Data

May 26, 1986 [JP] Japan ..... 61-121676
Jun. 5, 1986 [JP] Japan ..... 61-132163
Aug. 26, 1986 [JP] Japan ..... 61-200687

[51] Int. Cl.[4] ..... C25D 5/26; C25D 7/06

[52] U.S. Cl. ..... 204/28; 72/47; 204/34; 204/37.1

[58] Field of Search ..... 204/28, 37.1, 34; 72/274, 47; 427/309, 328

[56] References Cited

U.S. PATENT DOCUMENTS 3,869,355 3/1975 Mathias ..... 204/32.1
4,050,996 9/1977 Klingenmaier ..... 204/28
4,265,678 5/1981 Hachisuka et al. ..... 148/12 B
4,545,834 10/1985 Shemenski et al. ..... 156/124

FOREIGN PATENT DOCUMENTS 62-47497 3/1987 Japan .

OTHER PUBLICATIONS

F. A. Lowenheim, Electroplating, McGraw-Hill Book Co., New York, 1978, pp. 79–80.

*Primary Examiner*—John F. Niebling
*Assistant Examiner*—William T. Leader
*Attorney, Agent, or Firm*—Cushman, Darby & Cushman

[57] ABSTRACT

A process for producing a metal wire for use as a reinforcement of rubber products, in which the step of drawing a steel wire is preceded by a preliminary treatment that includes the step of smoothing the surface of the steel wire by electropolishing and the step of forming on the smoothed surface of the steel wire a coating of any one metal selected from the group consisting of copper, zinc, a copper-zinc binary alloy, and a ternary alloy which is composed of copper, zinc and third element selected from among nickel, cobalt, tin and iron.

6 Claims, 2 Drawing Sheets

STEEL CORD WITH Cu-Zn BINARY ALLAY COATING

STEEL CORD WITH Cu-Zn-Ni TERNARY ALLAY COATING

PROCESS FOR PRODUCING A METAL WIRE USEFUL AS RUBBER PRODUCT REINFORCEMENT

BACKGROUND OF THE INVENTION

The present invention relates to a process for producing a metal wire used in reinforecement of rubber products such as tires, hoses and conveyor belts. More particularly, the present invention relates to an effective method for improving the adhesion between rubber and a metal wire.

Embedding a variety of reinforcing meterials in rubber is one of the techniques that are extensively employed for the purpose of improving the strength and durability of rubber products. Composites of rubber and steel reinforcement are applied to automotive tires, high-pressure rubber hoses and conveyor belts. While the requirements for the quality and performance of such composites widely vary in accordance with the specific area of application, it is required in all situations that the adhesion between rubber and the steel reinforcement is increased to improve the durability of the composites.

With the rapid increase in the number of expressways being constructed, there has been a strong need to enhance the durability and steering stability at high speed of radial tires using reinforcement steel cords coated with a Cu-Zn binary alloy. To meet this need, improvement in the adhesion between steel cords and rubber is of extreme importance.

With a view to improving the adhesion between steel reinforcements and rubber, studies have been conducted with two approaches, one being directed to improvements of metal wire and the other intended to improve rubber. In the first approach, efforts have been made to attain the objective not only by optimizing the composition and thickness of the metal coating but also by performing a more stringent process control over the wire production including such steps as preliminary treatments, application of metal coating on the wire, drawing the wire into a smaller diameter, but the results of these efforts are not completely satisfactory. Especially, in the drawing step of steel wires, they are drawn to have their cross-section area reduced by at least 80% so that local separation of the coating frequently occurs, which is one of the major causes of the drop in the adhesion between steel wires and rubber. In order to solve this problem, considerable efforts have so far been made to improve the configuration and arrangement of wire drawing dies or the properties of lubricants used in the drawing operation but they have met with only limited success.

During the service of rubber products, the adhesion between metal wires and rubber can deteriorate for several reasons such as the entrance of water by way of flaws that have occurred in the rubber or, in the case of automotive tires, the penetration of salt water originating from the sodium chloride used as a deicing chemical. In order to solve this problem, it has been proposed that the metal wires are coated with a ternary alloy system consisting of a copper-zinc alloy plus a third element selected from among nickel, cobalt, tin and iron (see, for example, U.S. Pat. No. 4,226,918, U.S. Pat. No. 4,255,496, U.S. Pat. No. 4,446,198 and Japanese Patent Application No. 27925/1973). This method, however, has the disadvantage that the proposed ternary alloy systems have a lower degree of workability than binary systems and metal wires coated with such ternary alloys will experience more frequent separation of the coating during the drawing step. If such metal wires were produced in large quantities and embedded in rubber products, the initial adhesion (i.e., the adhesion developing immediately after vulcanization between the metal wires and the rubber products) would be at very low levels. Because of this serious disadvantage, the idea of coating metal wires with ternary alloy systems is difficult to commercialize.

With a view to improving the adhesion between metal wires and rubber, the present invention searched for the cause of the local separation of metal coatings from steel wires that occurs during their drawing operation and found the most probable cause. In order to identify the cause, the present inventors conducted microscopic observations of metal coatings on steel wires at the exit end of each of the dies employed in the drawing step and found that the smoothness of the surface of uncoated steel wires before drawing had effects on the strength of adhesion of metal coating on drawn wires and that metal coatings formed on steel wires with uneven surface smoothness had a greater tendency to experience local separation as a result of wire drawing. FIG. 1 is a sketch of a cross section of a prior art steel wire with a metal coating as examined with a scanning electron microscope (SEM). As FIG. 1(*a*) shows, the undrawn steel wire 1 serving as the substrate of a metal coating had a very uneven surface, and when it was drawn to a certain extent, local separation of the metal coating 2 occurred at some high spots of the surface irregularities.

During the course of the investigation described above, the present inventors also found that the low surface smoothness of the steel wire, or the great asperity of its surface, had already occurred before it was passed into the stage of application of the metal coating. The current practice of performing preliminary treatments for the application of metal coatings is solely directed to descaling or surface activation and is little effective for the purpose of improving the surface smoothness. Most of the steel wires that have been subjected to such preliminary treatments have an average surface roughness of at least 2 μm, and between about 2 and 5 μm for wire diameters of 0.5 to 3 mm, and have experienced local separation of metal coating after the wires were drawn. Ruth Giuffria et al. reported the presence of the considerable irregularities in the surface of the substrate (undrawn steel wire) of metal coatings (Ruth Giuffria et al.; Rubber Chemistry and Technology, vol. 55, 1982, pp. 513–524). However, they did not show at all how the metal coating formed on steel wires with an uneven surface would change as a result or wire drawing or what effects the surface irregularities would have on the adhesion between drawn metal wires and rubber.

SUMMARY OF THE INVENTION

Under the circumstances described above, the present inventors thought that for the purpose of inhibiting the separation of metal coatings from steel wires as as result of wire drawing, it would be effective to include in the preliminary treatment for metal coating application the step of smoothing the surface of the steel wire by electropolishing. To verify the effectiveness of this idea, the present inventors applied this smoothing treatment to steel wires, formed metal coatings on the wires, and conducted a microscopic investigation of the state of the metal coatings after drawing the wires. this treatment was found to be effective in decreasing the separation of the metal coatings from the steel wires due to their drawings, with a subsequent improvement in the adhesion of steel wires to rubber. The present invention has been accomplished on the basis of these new findings.

Therefore, an object of the present invention is to provide a process for producing a metal wire useful as a reinforcement of rubber products, in which the step of drawing a steel wire is preceded by a preliminary treatment that includes the step of smoothing the surface of the steel wire by electropolishing and the step of forming on the smoothed surface of the steel wire a coating of any one metal selected from the group consisting of copper, zinc, a copper-zinc binary alloy and a ternary alloy which is composed of copper, zinc and a third element selected from among nickel, cobalt, tin and iron.

BRIEF DESCRIPTION OF THE DRAWINGS

FIG. 1(*b*) shows the prior art steel wire after being drawn by a reduction in area of up to 30%;

FIG. 2(*b*) shows the wire of the present invention after being drawn by a reduction in area or up to 80%.

DETAILED DESCRIPTION OF THE EMBODIMENTS

The process of the present invention proceeds as follows: a steel wire is descaled either by pickling with an acid such as hydrochloric acid or sulfuric acid or by electrocleaning; then, the surface of the wire is smoothed by electropolishing with a suitable bath such as an aqueous solution of phosphoric acid that contains a minor amount of sulfuric acid or chromic acid, so as to decrease the average roughnees of the wire surface, preferably down to 2 μm or below, more preferably down to 1 μm or below; the smoothed steel is then coated with a layer of a metal selected from the group consisting of copper, zinc, a copper-zinc binary alloy, and a ternary alloy composed of copper, zinc and a third element selected from among nickel, cobalt, tin and iron; subsequently, the wire is drawn to a smaller diameter and a plurality of such steel wires are processed into a suitable product form such as a cord, gauze or fabric.

The smoothed steel wire preferably has an average surface roughness of 2 μm or below, more preferably 1 μm or below. If the average surface roughness of the smoothed wire is more than 1 μm, local separation of a metal coating is highly prone to occur when the wire is drawn by a reduction in area of 80% or more, and the intended feature of the present invention cannot be fully attained.

Methods commonly employed to smooth the surface of metallic materials include brushing, polishing with emery papers, electropolishing, chemical polishing, etc., but in order to attain an extremely high degree of surface smoothness (average roughness preferably being 2 μm or below, more preferably 1 μm or below) on very fine steel wire of the type contemplated by the present invention and for attaining the additional purpose of increasing the production rate by performing high-speed operation, electropolishing is the most preferable method to choose.

Figure 1A:
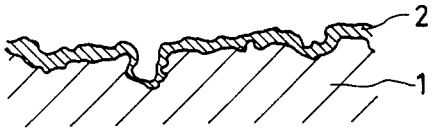
FIG. 1(*a*) is a sketch as examined by SEM, of a cross section of a prior art steel wire with a metal coating in the undrawn state.
Figure 1B:
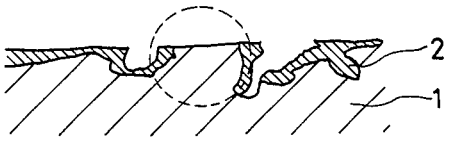
Figure 2A:
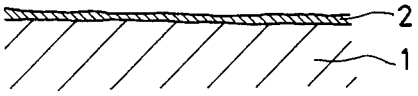
FIG. 2(*a*) is a sketch, as examined by SEM, of a cross section of a steel wire according to the present invention in the undrawn state.
Figure 2B:
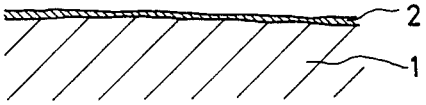

According to the process of the present invention in which the step of smoothing the surface of a steel wire by electropolishing is included as one of the preliminary treatments for application of a metal coating, the chance of local separation of the metal coating as a result of wire drawing is decreased and uniform deposition of the coating is ensured over the entire surface of the steel wire. FIG. 2 is a sketch of a cross section of a steel wire with a metal coating as examined by SEM after it was produced by the process of the present invention. As is evident from FIG. 2(*b*), the deposition of the metal coating 2 on the steel wire 1 that had been drawn to a certain extent was as uniform as when the wire was in the undrawn state (FIG. 2(*a*)) and the local separation of metal coating which extensively occurred in a prior art product (FIG. 1) was very rare.

Therefore, the metal wire produced by the method of the present invention retains a uniform metal coating and will hence guarantee improved adhesion to rubber when it is embedded in rubber products.

The following example is provided for the purpose of further illustrating the present invention but is in no sence to be taken as limiting.

EXAMPLE

Steel wires (1.25 mm$^{\Phi}$) were subjected to the following preliminary treatments for application of a metal coating; removal of surface scale by pickling and smoothing of the wire surfaces by electropolishing in an aqueous solution of a mixture of phosphoric acid and sulfuric acid. The smoothed wires had an average surface roughness of 0.9 μm. According to the present invention, two kinds of metal-coated steel wires were produced by the following two procedures; (1) after copper electroplating in a copper pyrophosphate bath followed by zinc electroplating in a zinc sulfate bath, a diffusion treatment was conducted by effecting resistance heating at 500° C. for 4 seconds so as to produce steel wires with a 1.6-μm thick coaling of copper-zinc binary alloy (63 wt% Cu and 37 wt% Zn); (2) after three successive plating, i.e., copper electroplating in a copper pyrophosphate bath, zinc electroplating in a zinc sulfate bath, and nickel electroplating in a Watts bath, a diffusion treatment was conducted by effecting resistance heating at 500° C. for 6 seconds so as to produce steel wires with a 1.5-μm thick coating of Cu-Zn-Ni ternary alloy (63 wt% Cu, 5.5 wt% Ni and 31.5 wt% Zn).

Two kinds of comparative samples were prepared by a conventional method; they had metal coatings with the same compositions and thicknesses shown above and had been subjected to the same preliminary treatment except that no surface smoothing by electropolishing was performed.

The so prepared steel wires were drawn to a diameter of 0.25 mm and twisted with a stranding machine to make steel cords of 1×5.

The adhesion of these steel cords to rubber was evaluated by the following method: a rubber sheet prepared from the compositions indicated in Table 1 below was attached to both sides of the steel cord and vulcanized at 150° C. for 30 minutes; thereafter, peeling test was conducted and the rubber coverage of the steel cord was rated by 5-point scaling (5 pint for 100% coverage, and O points for 0% coverage) with 0.5-point increments.

Figure 3A:
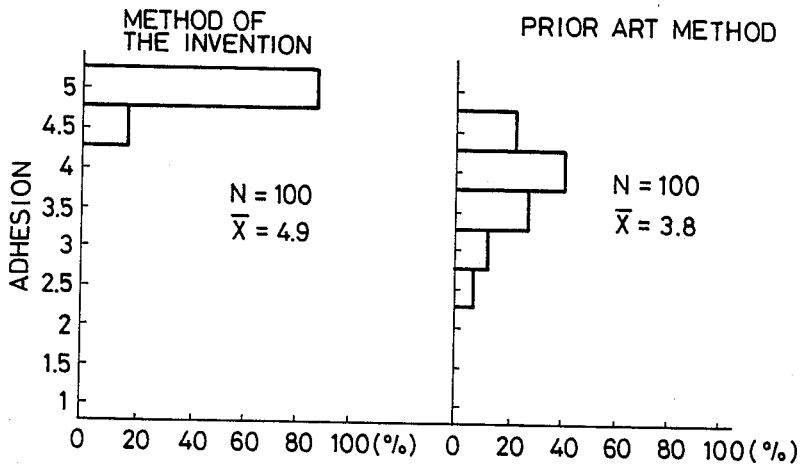
FIGS. 3(*a*) and 3(*b*) show histograms comparing the steel wires produced by the method of the present invention with prior art samples in terms of their adhesion to rubber.
Figure 3B:
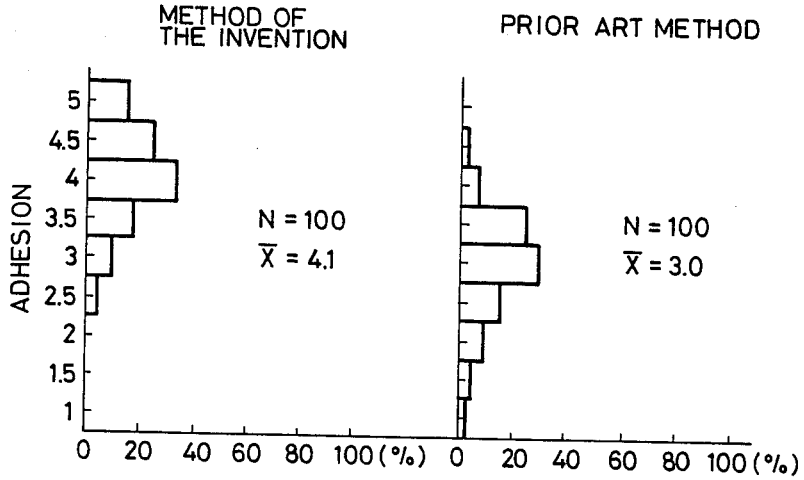

The test results are graphed in FIG. 3, from which it can be seen that the steel cords produced by the process of the present invention, which were coated with a Cu-Zu binary alloy or Cu-Zn-Ni ternary alloy, exhibited far better adhesion to rubber than the comparative samples prepared by conventional method.

TABLE 1

| Ingredients | Parts by weight |
|---|---|
| Natural rubber | 100 |
| Carbon black | 50 |
| Zinc white | 6 |
| Stearic acid | 1.5 |
| Cobalt naphthenate | 2.5 |
| Curing accelerator | 1.5 |
| Sulfur | 5 |

According to the present invention in which the surface of a steel wire is smoothed by electropolishing before it is coated with a metal layer, local separation of a subsequently formed metal coating can be inhibited even if the wire undergoes a significant reduction in cross-sectional area by drawing. As a result, the metal wire produced by the process of the present invention can be used as a reinforcement of rubber products that exhibits improved adhesion to rubber and thereby making great contribution to the enhanced reliability of the reinforced rubber products.

What is claimed is:

1. A process for producing a metal wire for use as a reinforcement of rubber products, comprising the steps of:

smoothing the surface of a steel wire by electropolishing to an average surface roughness of 1 μm or below;

forming on the smoothed surface of said steel wire a coating of any one metal selected from the group consisting of a copper-zinc binary alloy and a ternary alloy which is composed of copper, zinc and a third element selected from the group consisting of nickel, cobalt, tin and iron; and drawing the thus prepared steel wire to have its cross-sectional area reduced by at least 80%.

2. A process according to claim 1, wherein said copper-zinc binary alloy has a copper content of 55–75 wt% and the balance being zinc.

3. A process according to claim 1, wherein said ternary alloy has a copper content of 55–75 wt%, a third element content of 0.1–20 wt% and the balance being zinc.

4. A process according to claim 1, wherein the overall thickness of said metal coating is in the range of 0.2–3 μm.

5. A process according to claim 1, wherein said metal wire is either a drawn steel wire or a steel cord, for fabricating a metal gauze or a metal fabric produced from a plurality of such drawn steel wires.

6. A process according to claim 1, further comprising the step of fabricating a steel cord, a metal gauze or a metal fabric from the drawn steel wire.

* * * * *